US005412974A

United States Patent [19]

Häusler

[11] Patent Number: 5,412,974

[45] Date of Patent: May 9, 1995

[54] METHOD OF PRODUCING SEAMLESS PIPES UTILIZING A PLUG ROLLING PROCEDURE

[75] Inventor: Karl H. Häusler, Korschenbroich, Germany

[73] Assignee: Mannesmann Aktiengesellschaft, Dusseldorf, Germany

[21] Appl. No.: 49,059

[22] Filed: Apr. 16, 1993

[30] Foreign Application Priority Data

Apr. 16, 1992 [DE] Germany ..... 42 13 276.2

[51] Int. Cl.[6] ..... B21B 17/06

[52] U.S. Cl. ..... 72/370; 72/209

[58] Field of Search ..... 72/97, 208, 209, 368, 72/370

[56] References Cited

U.S. PATENT DOCUMENTS

| | | | |
|---|---|---|---|
| 770,195 | 9/1904 | Stiefel et al. | 72/209 |
| 1,858,990 | 5/1932 | Foren | 72/235 |
| 3,911,714 | 10/1975 | Kamimura et al. | 72/209 |
| 4,798,071 | 1/1989 | Staat et al. | 72/97 |

FOREIGN PATENT DOCUMENTS

| | | | |
|---|---|---|---|
| 0227508 | 10/1987 | Japan | 72/209 |
| 0149004 | 6/1988 | Japan | 72/97 |
| 2239414 | 7/1991 | United Kingdom | 72/209 |
| 1502145 | 8/1989 | U.S.S.R. | 72/252.5 |

*Primary Examiner*—Lowell A. Larson
*Assistant Examiner*—Thomas C. Schoeffler
*Attorney, Agent, or Firm*—Cohen, Pontani, Lieberman, Pavane

[57] ABSTRACT

A method of producing seamless pipes by carrying out a plug rolling procedure includes expanding and stretching a hollow ingot into a bloom by carrying out at least two consecutive passes in a roll stand having a box-groove and by using a stationary plug supported by a rod. The bloom is pulled after each pass from the rod in a direction opposite the rolling direction. The bloom is turned after each pass by 90° C. about a longitudinal axis thereof and the plug is exchanged after each pass. The method further includes the step of adjusting in one of the passes a wall thickness of the bloom in a wall portion of the bloom at the groove bottom by changing the roll distance in order to thin-stretching the wall portion such that the wall thickness of the finish-rolled bloom is uniform over the circumference thereof.

3 Claims, No Drawings

METHOD OF PRODUCING SEAMLESS PIPES UTILIZING A PLUG ROLLING PROCEDURE

BACKGROUND OF THE INVENTION

1. Field of the Invention

The present invention relates to a method of producing seamless pipes by carrying out a plug rolling procedure or a piercing procedure. In this method, a hollow ingot is expanded and stretched to form a bloom in a box-groove rolling mill by carrying out at least two roll passes, and using a stationary piercer or plug supported on a rod. The bloom is drawn off from the rod in a direction opposite the rolling direction after each roll pass by means of a driving unit and is rotated by 90° about its longitudinal axis before carrying out a subsequent pass.

2. Description of the Related Art

In known rolling methods of producing seamless steel pipes, a distinction is made between longitudinal rolling procedures and cross rolling procedures. In contrast to the cross rolling procedure, the longitudinal rolling procedure requires an essentially round and closed or box-groove which must be adapted to the desired cross section of the pipe. The present invention deals with a longitudinal rolling procedure using an internal tool, i.e., a procedure which has become known as the plug rolling procedure or piercing procedure.

Plug rolling installations have been substantially developed by Stiefel. Stiefel-type rolling mills originally included a piercing cross rolling installation, a stretching cross rolling installation, a Stiefel-type plug rolling installation, and at least one reeling installation which were arranged in front of a reducing rolling mill train as the finishing stage. Since a considerable loss in temperature occurred in the pipe during the many stages from the piercing rolling mill to the reducing rolling mill train, the pipes were generally reheated to reducing rolling temperature after reeling rolling in a furnace provided especially for this purpose.

The original Stiefel-type plug rolling installation had rolls with a plurality of adjacent grooves cut into the rolls. Later, single-groove plug rolling installations were developed because the multiple-groove rolls resulted in inaccuracies of the rolled product because of bending or sagging of the rolls.

In known plug rolling mills, a hollow ingot is rolled in preferably two to three passes into a bloom with the use of a stationary plug which is supported on a rod. After each pass, the bloom is pulled by means of a driving unit from the rod in a direction against the rolling direction, and the bloom is turned by 90° before being introduced into the next pass. The plugs are exchanged after each pass.

It is currently common to use plugs having a short working length, wherein the diameter of the plugs is greater than the internal diameter of the hollow ingot. An operation in which the hollow ingot has a greater internal diameter than the diameter of the first plug is also known. In the first case, the hollow ingots are expanded by means of the plug which results in more favorable gripping conditions of the rolls. The plugs having a short working length are economical and greater wall thickness reductions can be achieved because of the favorable gripping conditions. The plug diameter of the second pass is usually slightly greater than that of the first pass, while the third plug may have a diameter which is equal to or greater than the diameter of the second plug.

At present, modern pipe rolling procedures generally include the following steps: piercing rolling, main stretching and finish stretching, wherein the pipe is finish-rolled with the application of heat. Compared to this pipe rolling procedure, the known plug rolling procedure has considerable disadvantages. These disadvantages are due to the fact that even after a third plug pass, the blooms still have increased wall thickness portions extending in longitudinal direction of the bloom, so that it is necessary to smoothen the blooms after plug rolling in a reeling installation. In most cases, two reeling installations are used in order to equalize the increased wall thickness portions; this is necessary because the rolling speed in such installations is very low. The reeling installations usually constitute the bottleneck of the rolling mill. Since the temperature of the blooms drops substantially as a result of the low rolling speeds and the lengthy rolling procedure, the blooms are usually reheated prior to rolling in sizing rolling mill trains, reducing rolling mill trains or stretching and reducing rolling mill trains. As a result, the plug rolling mill is very expensive and uneconomical as compared to other rolling mills.

SUMMARY OF THE INVENTION

Therefore, it is a primary object of the present invention to provide a plug rolling procedure of the conventional type which is modified in such a way that the reeling installations and the reheating furnace can be omitted. Specifically, a plug rolling mill train is to be provided which is capable of rolling blooms which do not have the increased wall thickness portions which were typical in the past for this type of procedure.

In accordance with the present invention, the above-described method includes the step of adjusting in one of the passes, preferably in the first pass, a wall thickness of the bloom in a wall portion of the bloom at the groove bottom by changing the spacing between the rolls in order to thin stretch the wall portion such that the wall thickness of the finish-rolled bloom is uniform over the circumference thereof.

DESCRIPTION OF THE PREFERRED EMBODIMENT

The present invention is based on the finding that, after passing through the first roll stand, i.e., after the first pass in plug rolling mills, the hollow ingot introduced into a longitudinal rolling installation has become thinner even in the pass jump relative to the wall thickness of the hollow ingot while the wall thickness reduction has been adapted accordingly, even though portions of the pass jumps on the bloom have not come into contact with the rolls. The same phenomenon can also be observed in the second and following roll passes until the stretching in the respective stand or roll pass has reached a value close to 0.

While roll stands with a low degree of stretching can be used in continuous pipe rolling mill trains with freely traveling rolling rod by using a larger number of roll stands on the last stand locations, the above-described phenomenon is particularly significant in plug rolling installations which roll in only three passes or even fewer passes. Because of the low number of passes, a relatively high degree of stretching is required. Smoothing is not possible in the final roll pass. If a normal conventional pass configuration of a plug rolling mill were used, it would actually be necessary to adjust already in the first pass in the groove bottom a wall thickness which corresponds to the later finished wall thickness. This would have the result that in the second stand or in the second pass, this wall would be stretched thinner by the thinning-stretching effect in the region of the roll jump than would be permitted by the finished wall thickness. In other words, the bloom would be located outside of the permissible wall thickness tolerances. Thus, the present invention proposes to add the extent of thinning-stretching in the pass jump of the next following groove as an addition to the groove bottom of the preceding stand or pass, with the object of achieving a wall thickness configuration which is uniform along the cross section.

At the same time, the rolls are opened prior to the first roll pass by moving the rolls apart until a spacing or distance between the rolls is reached which corresponds to the wall thickness to be adjusted in the region of the groove bottom. Since in a single-groove plug rolling installation all passes have to be rolled in one and the same groove, which is in contrast to continuous longitudinal rolling procedures, i.e., a continuous pipe rolling train, it is possible in plug rolling methods to obtain a variation of the pass configuration by adjusting the rolls differently during the various passes. For example, in order to achieve in the first pass a wall thickness increase toward the thinning-stretching of the wall in the roll jump area of the second pass, the rolls can be opened prior to the first pass by the extent of this addition. In the case of three passes, the rolls can also be opened prior to the second pass.

In accordance with a preferred further development of the method according to the present invention, the adjustment of the wall thickness pattern in the next following pass is carried out in the groove bottom of the preceding pass by an appropriate shape of the mathematically or empirically determined contour curve describing the groove bottom. It has been found that thinning-stretching of the wall in the pass jump does not necessarily take place over the entire freely formed area with a constant wall thickness reduction. Rather, a different wall thickness occurs depending on whether the exact middle of the pass jump is considered or adjacent zones. A round and exactly centric pass configuration may possibly lead to inaccurate wall thicknesses. The wall thickness itself is predetermined in the groove bottom by an appropriate selection of the plug diameter. Thus, if an addition is to be provided for the wall in the groove bottom, the plug diameter of this pass has to be reduced accordingly. However, this means that a large number of plugs with finely graduated diameters are required and an expensive supply of plugs must be available.

The proposed features of the present invention make it possible by a suitable selection of the roll pass configuration, the extent of opening of the rolls and the plug diameter, to achieve a uniform wall thickness which is within the permissible tolerances already in the plug rolling installation, which makes it possible, in accordance with another feature of the present invention, to transport the pipe immediately after the plug rolling procedure to a sizing mill, a reducing mill or a stretching reducing mill. When carrying out the method according to the present invention, reeling installations are entirely unnecessary, so that it is also no longer necessary to reheat the blooms because of the fact that the time required for rolling has been reduced. Thus, a reheating furnace is also not required.

As a result of the method proposed by the present invention, the plug rolling process becomes again significant and is able to compete with other modern rolling procedures.

It should be understood that the preferred embodiment and examples described are for illustrative purposes only and are not to be construed as limiting the scope of the present invention which is properly delineated only in the appended claims.

I claim:

1. A method of producing seamless pipes by carrying out a plug rolling procedure in a rolling direction, the method comprising expanding and stretching a hollow ingot into a bloom by carrying out at least two consecutive passes in a single roll stand having rolls defining a box-groove and by using a stationary plug supported by a rod, pulling the bloom after each pass by means of a driving unit from the rod in a direction opposite the rolling direction, turning the bloom after each pass by 90° C. about a longitudinal axis thereof before carrying out a subsequent pass, wherein the plug is exchanged after each pass, the groove having a bottom, the rolls being adjustable relative to each other to be spaced apart by a roll distance, the bloom having a wall and a circumference, further comprising the step of adjusting in a first pass a wall thickness of the bloom in a wall portion of the bloom at the groove bottom by changing and maintaing the roll distance in order to take into account thin-stretch of said wall portion in a subsequent pass such that the wall thickness of finish-rolled bloom is uniform over the circumference thereof thereby eliminating a need for any subsequent reeling installation processing of the finish-rolled bloom.

2. The method according to claim 1, comprising adjusting the wall thickness in the groove bottom by providing the groove bottom with a contour curve which is determined mathematically or empirically.

3. The method according to claim 1, comprising one of sizing rolling, reducing rolling or a stretch-reducing rolling the pipe immediately following the plug rolling procedure.

* * * * *